US005762489A

United States Patent [19]

Wunning

[11] Patent Number: 5,762,489

[45] Date of Patent: Jun. 9, 1998

[54] RADIANT HEAT EXCHANGE TUBE WITH FURNACE WALL FOR INDUSTRIAL FURNACES

[75] Inventor: Joachim Wunning, Leonberg, Germany

[73] Assignee: WS Wärmeprozesstechnik GmbH, Renningen, Germany

[21] Appl. No.: 601,076

[22] Filed: Feb. 12, 1996

[30] Foreign Application Priority Data

Feb. 17, 1995 [DE] Germany ..... 195 05 401.6

[51] Int. Cl.[6] ..... F23D 14/46

[52] U.S. Cl. ..... 431/353; 431/159; 431/35 D; 126/91 A; 165/DIG. 52; 165/DIG. 57

[58] Field of Search ..... 431/35, 215, 353; 126/91 A, 91 R; 165/DIG. 68, DIG. 67, DIG. 52, DIG. 53, DIG. 57, DIG. 58, DIG. 59

[56] References Cited

U.S. PATENT DOCUMENTS

| | | | |
|---|---|---|---|
| 2,632,503 | 3/1953 | Bailey | 126/91 A |
| 3,425,675 | 2/1969 | Twine | 126/91 A |
| 3,747,206 | 7/1973 | Pease . | |
| 4,134,449 | 1/1979 | Lahaye et al. | 126/91 A |

FOREIGN PATENT DOCUMENTS

| | | |
|---|---|---|
| 904 881 | 3/1945 | France . |
| 1 263 031 | 4/1961 | France . |
| 1 565 466 | 9/1969 | Germany . |
| 41 32 236 C1 | 10/1992 | Germany . |
| 2 145 482 | 3/1985 | United Kingdom . |

*Primary Examiner*—Carl D. Price
*Attorney, Agent, or Firm*—Frishauf, Holtz, Goodman, Langer & Chick, P.C.

[57] ABSTRACT

To sealingly retain a radiant heat exchange tube extending through an opening (5) in a wall (3) of a furnace, and to isolate the atmosphere within the furnace space (2) from outside ambient space, a thin-wall sleeve (25) has a first portion (40) shrinkfitted around the radiant heat exchange tube (7) which, for high temperature resistance, is made of a ceramic, preferably silicon carbide. A second portion (42, 44, 46) of the sleeve (25) which conically expands, is secured to a flange element (23), for example by welding, which, in turn, is secured for examples by screws, to a flange structure (8) on the wall (3) of the furnace. The flange element (23) has an inner diameter which is greater than the outer diameter of the tube (7). The sleeve (25) is preferably made of iron-nickel and has a wall thickness which is about 1/10 of the wall thickness of the ceramic tube (7). The shrink-connected sleeve (25) likewise accepts differential expansion of materials under temperature changes and has a thermal coefficient of expansion which is less than, or at most, equal to that of the ceramic material of the tube. A support tube (30) can also be secured to the flange, and terminating at an intermediate length portion of the tube (7) surrounding, but slightly spaced from, the tube at the terminating end with a small clearance, to prevent tube breakage in case of vibration or shock.

15 Claims, 2 Drawing Sheets

RADIANT HEAT EXCHANGE TUBE WITH FURNACE WALL FOR INDUSTRIAL FURNACES

FIELD OF THE INVENTION.

The present invention relates to a radiant heat exchange tube or pipe, of ceramic material, which includes a sealing arrangement to seal the ceramic tube to the wall of a furnace through which the tube is passed.

BACKGROUND.

Industrial furnaces can be indirectly heated or cooled by utilizing heat exchange tubes or the like, passed through openings in the wall of the furnace, and sealed against the furnace wall. To supply, or remove heat, burners, electro-heating arrangements, or cooling systems, respectively, are coupled to the tube. The tube may be made of heat-resistant steel; increasingly, however, ceramics are used because they permit use of higher temperatures. A typical ceramic is silicon carbide ceramic.

The tube must be secured to the wall portion of the furnace, surrounding the opening through which the tube is passed into the furnace, and at the same time sealed. It has been proposed to clamp a ceramic flange formed on the tube between two metallic flange elements, one of which is gas-tightly secured to the wall of the furnace. Elastic seals, such as seal rings and the like, are available to accept temperatures of up to about 250° C., and which can accept the different expansions of the metal flange and of the ceramic flange, respectively. An engagement force is applied, frequently by spring elements.

If the temperature at the flanges exceeds 250° C., the seals must be made of relatively stiff material, for example metal rings. Such seals require engagement against predetermined surfaces on the ceramic flange, which, in turn, requires expensive grinding operations on the flange. The danger of fissures or cracks in the ceramic is always present, since the engagement forces must be high when stiff seals are used.

Silicon carbide ceramics form particularly suitable materials for such tubes, since they have a heat conduction of over 50 W/mK. Temperatures at the flange frequently rise above 250° C., particularly if hot gases from a burner, or exhaust from a cooling system, flow passed these flanges.

German Patent DE 41 32 236 C1 describes an industrial furnace and burner using a ceramic heat exchange tube. The heat exchange tube is formed with a ceramic flange and the tube is pressed, with the interposition of a sealing ring, against an inner shoulder of a tubular portion of the housing. To secure the tube, and for additional sealing, a second sealing ring is provided which is located in a ring groove or gap delimited by the tubular housing portion and the ceramic tube. Springs located within a burner head press the ceramic tube with its flange against the seal and counter the sealing ring which is engaged on the inner shoulder.

Metal rings are used as sealing rings if the heat loading exceeds 250° C. They require a ground flange for proper seating.

THE INVENTION.

It is an object to provide a sturdy, sealed radiant heat exchange tube for industrial furnaces, in which the seal is substantially simplified and improved, and does not require grinding or polishing of ceramic surfaces.

Briefly, a thin wall sleeve has a first portion which is shrink-fitted around the ceramic radiant heat exchange tube, and a second portion which is sealingly connected to a metallic ring, or flange element which, in turn, is coupled to the wall of the furnace. The flange element has a disk-shaped portion in which the inner diameter of its opening is greater than the outer diameter of the ceramic tube element. Consequently, the second portion of the thin wall sleeve can be spaced from the tube, to allow for differences in expansion and shrinkage upon change in temperature.

The flange element of the tube is metallic and can be readily secured to a flange or attachment ring or the like on the wall of the furnace, for example by screw, or bolt connection. The metallic sleeve, located between the flange portion or element and the tube itself not only ensures that the connection will be tight and sealed, but also provides a holding arrangement with respect to axial forces. The first portion of the sleeve, shrink-fitted on the tube, forms an essentially gas-tight connection. The sleeve is thin-walled, that is, it has a wall thickness which is substantially less than that of the tube. The ceramic tube usually has a wall thickness between 4 and 10 mm, and is stiff with respect to the sleeve. The sleeve, upon shrink-fitting on the tube, thus can fit itself snugly on the outer circumference and wall of the heat exchange tube. Any grinding, or polishing of the tube, therefore, can be eliminated. Slight roughnesses, or deviations of the surface from a smooth surface can be easily tolerated, since the thin-walled sleeve, upon shrink-fitting about the tube, will form itself around any irregularities. Additionally, tolerances in diameters, or deviations from exact roundness of the tube, can be readily accommodated and compensated for by the shrink-fitted sleeve. Tension forces which arise in the sleeve upon shrink-fitting can be readily accepted by the ceramic, which has a substantially higher wall thickness than that of the sleeve, and which can be designed with a suitable wall thickness to accept such tension forces.

The sleeve forms a sturdy connection between the flange and the tube. Yet, the connection has some "give", so that different thermal expansions of the tube and of the flange portion will not lead to fissures or leaks. The arrangement also protects the tube at all temperature differences which arise from tensions applied thereto.

The first and second portions of the sleeve are generally tubular. The second portion, starting from the first one, is of larger diameter, and expanded, for example in generally conical shape, which may then merge into a cylindrical portion. The second portion, with gradually increasing diameter, forms a transition element to the flange with a greater inner diameter than the outer diameter of the tube. Differences in thermal coefficients of expansion of the tube and of the flange portion can be particularly easily accepted by the second portion of the tube if, in accordance with a preferred embodiment, the second portion of the tube is, at least in part, generally conical.

A simple arrangement can be obtained when the sleeve is so shaped that its second portion is not integral with the flange itself. The overall length of the sleeve can be reduced by folding the second portion of the sleeve, back around the first shrink-fitted portion of the tube. The second portion will then be positioned essentially concentric with respect to the first portion of the sleeve.

In accordance with a preferred embodiment of the invention, and for most applications, it is desirable to form the heat exchange tube of silicon carbide ceramic, which has a high degree of resistance to high temperatures. Unfortunately, however, it has a high degree of heat conductivity as well, so that the end which is gripped by the first portion of the sleeve may be heated to a relatively high temperature. The shrink-fit, however, can accept the temperatures which arise at the heat exchange tube. The heat exchange tube usually has a diameter between about 50 and 250 mm, with wall thicknesses, for these dimensions, of from 4 to 7 mm. The wall thickness of the sleeve is usually less than 1 mm, so that it acts as an elastic spring element, due to the difference in materials and wall thicknesses.

Preferably, the sleeve is of a material which has a thermal coefficient of expansion which, within the temperature range to which the tube is exposed, is at most equal to, or less than that of the ceramic of the tube. In this case, the shrink fit will be equally secure at all temperatures and, as the temperature increases, even increases its gripping force. Iron-nickel alloys with low thermal coefficients of expansion are particularly suitable for the sleeve.

Gas-tightness between the sleeve and the tube can be increased by inserting a sealing substance between the first portion and the tube. Materials particularly suitable for higher temperatures are, for example, graphite, or a solder.

The sleeve positions the heat exchange tube in axial direction. An additional support tube or pipe can be provided to protect the heat exchange tube against bending stresses which may occur, particularly if the heat exchange tube is positioned in an arrangement which deviates from a vertical direction. The additional support tube or pipe can be welded to the sleeve, or can be secured to the flange portion, and extend coaxially with respect to the heat exchange tube. In accordance with a preferred feature of the invention, it is desirable to so place the support tube and the heat exchange tube that a ring gap will be formed, permitting some radial play. This radial play prevents introduction of stresses into the heat exchange tube which might lead to destruction thereof. Preferably, the ring gap decreases in diameter towards the inner end of the heat exchange tube, so that the support tube will form an engagement region for the heat tube at the end portion of the support tube. Any bending torques, or oscillations due to vibration acting on the heat exchange tube between the end of the support tube, and of the sleeve, respectively, can then be accepted by the flange. Almost the entire length of the support tube can be used as a lever, so that any forces acting on the heat exchange tube can be readily accepted. In particular, they are smaller than the reaction forces which arise already upon clamping of the ceramic heat exchange tube at its mouth end.

The radiant heat exchange tube is preferably used for heating or cooling a furnace space having a protective gas atmosphere therein. The flange portion pneumatically separates two gas spaces, namely the space within the furnace, and the ambient surrounding space. The heat exchange tube, with its flange portion, is screw-connected to a flange formed on a suitable portion of the furnace wall, formed with an opening through which the heat exchange tube is passed.

DRAWINGS.

FIG. 1 is a highly schematic side view of a portion of an industrial furnace wall, through which a heat exchange tube is passed and held in sealed condition, heated by an industrial burner; and FIG. 2 is a fragmentary view of FIG. 1, illustrating, to a greatly enlarged scale with respect to FIG. 1, in schematic side view, a portion of the heat exchange tube and the sealing arrangement therefor.

DETAILED DESCRIPTION.

Figure 1:
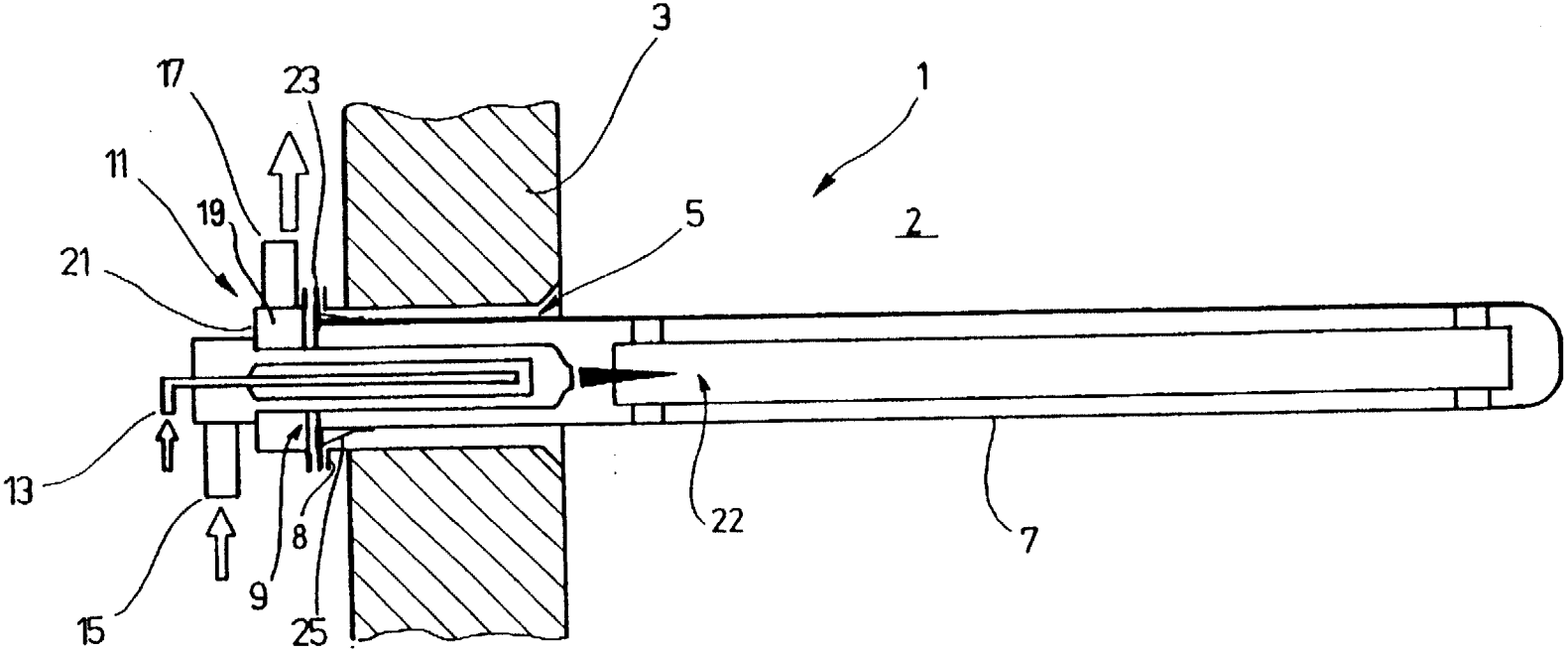

FIG. 1, highly schematically, shows a wall 3 of an industrial furnace 1, delimiting an interior furnace space 2. A radiant heat exchange tube 7, passed through an opening 5 in the wall 3, provides for indirect heating of the space 2 within the furnace. The heat exchange tube 7, passing through the opening 5, is secured to a flange 8 which, in turn, is attached to the wall 3 of the furnace. The end of the heat exchange tube 7 which extends into the furnace space 2 is closed. The other open end 9 is coupled to an industrial burner 11, having connections 13 and 15 to supply combustion gas and air, as well as a connection 17 to remove combustion gases. The connection 17 is coupled to a ring-shaped exhaust manifold or chamber 19 of a tubular housing portion 21. An exhaust gas duct delimited by the heat exchange tube 7 terminates in the exhaust gas chamber 19 within the housing part 21. When the heat exchange tube 7 becomes heated by combustion of combustion gases supplied thereinto at 22, hot exhaust gases will arise at the end 9 to be emitted from the heat exchange tube 7.

Figure 2:
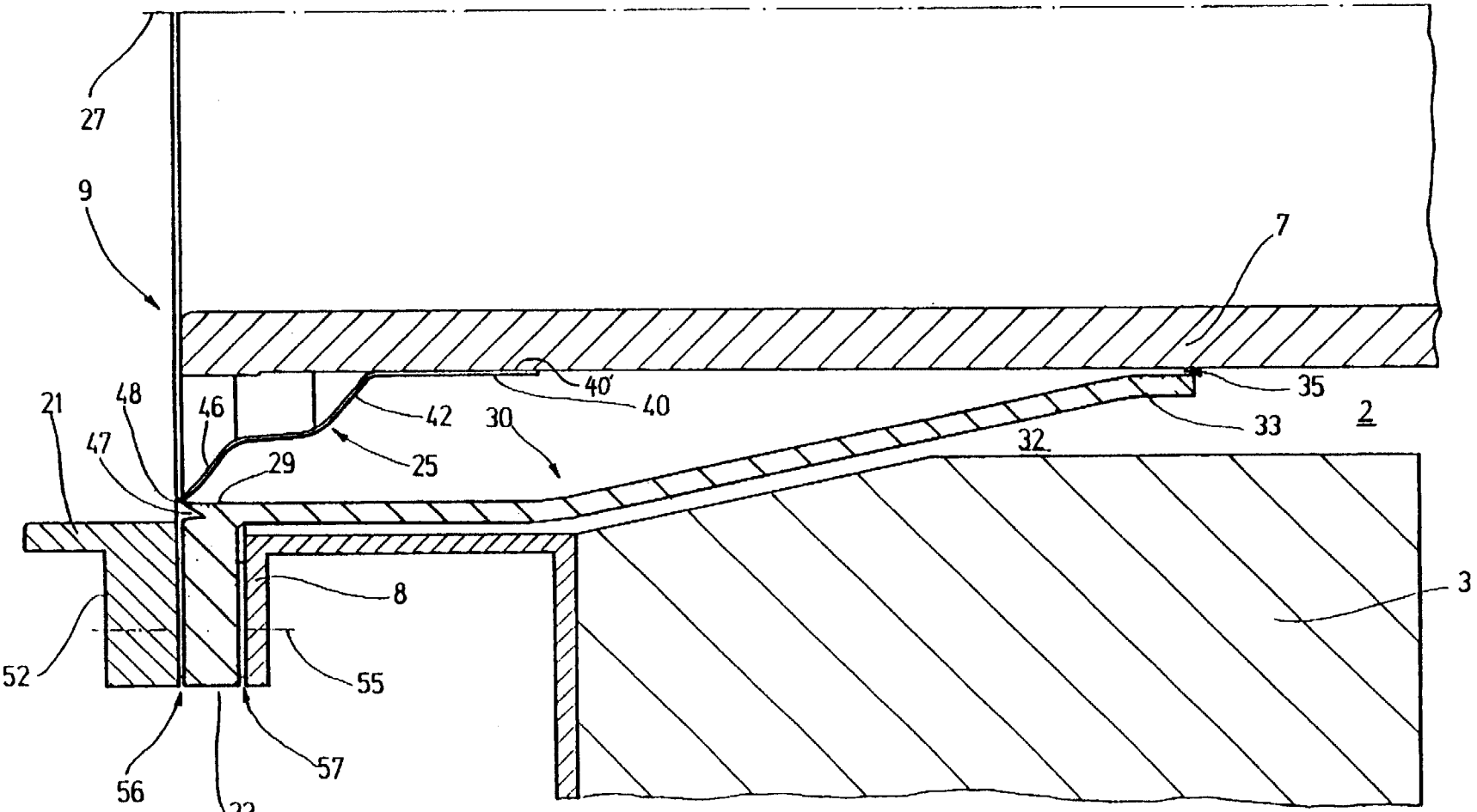

In accordance with the present invention, the heat exchange tube 7 is coupled to the wall 3 of the furnace or, respectively, the flange 8 thereof with a metallic flange portion 23 which, in turn, is secured to a thin walled sleeve 25, which is best seen in FIG. 2. The flange portion 23 is rotation symmetrically concentric with respect to a longitudinal central axis 27 of the heat exchange tube 7. The flange portion, or part 23 has the shape of a ring disk and merges into a support tube 30, extending coaxially with respect to the axis 27, as a merging portion, or end 29 of the flange portion. The support tube 30, starting from the flange portion 23, is, initially, hollow cylindrical with an inner diameter substantially exceeding the outer diameter of the heat exchange tube 7. Starting from the end 9 of the heat exchange tube 7, the support tube 30 then merges with a constricting essentially conical portion 32 which terminates in a narrower hollow cylindrical portion 33, which, together with the heat exchange tube 7, defines a narrow ring gap 35. The heat exchange tube 7, which may have an outer diameter of between 50 and 250 mm, and a wall thickness of from 3 to 10 mm, usually 4 to 7 mm, can easily be fitted within the support tube which may have a comparable wall thickness, but at its portion 30, have an inner diameter which is a few millimeters larger than the outer diameter of the heat exchange tube 7.

In contrast to the support tube 30, the sleeve 25 has a wall thickness, throughout, of less than 1 mm. The relationship of wall thickness of the sleeve 25 to that of the heat exchange tube 7 is preferably about 1:10. Consequently, sleeve 25 is elastic with respect to the thick-walled stiff tube 7.

The heat exchange tube 7 and the sleeve 25 are coupled together at a first hollow cylindrical portion 40 of the sleeve 25, which is shrink-fitted on the heat exchange tube 7. The sleeve 25, towards the end 9 of the heat exchange tube 7, then merges into a second portion 42, which is of generally conical configuration, to then merge with a generally hollow cylindrical portion 44, which then, in turn, merges with a second and sharply divergent conical portion 46. The end of the conical portion 46 is welded to the flange 23 by a weld seam 48. The weld seam 48 extends over the entire circumference of the opening defined by the flange portion 23, so that the sleeve 25 seals the heat exchange tube 7 in gas-tight manner with respect to the flange 23.

Immediately adjacent the weld seam 48, the flange portion 23 is formed with an axially extending ring groove 47, which facilitates welding of the sleeve 25 on the flange 23.

The sleeve 25, which is a spring element, is made, preferably, of a nickel-iron alloy, which has a temperature coefficient of expansion equal to or less than the coefficient of the heat exchange tube 7. Thus, the gas-tight shrink connection between the portion 40 of the sleeve 25 and the tube 7 will remain, even when the end portion 9 of the tube 7 becomes hot, for example exceeding temperatures of 300° C. and more. Independent of the temperature of the tube 7, the elastically expanded portion 40 of the sleeve 25 provides a radially inwardly directed compressive force on the heat exchange tube 7, which can be readily accepted thereby.

The seal between the portion 40 of the sleeve 25 and of the heat exchange tube 7 can be improved by placing sealing means between the sleeve 25 and the heat exchange tube 7. This is particularly suitable when the tube 7 has a rough surface. Suitable sealing means are a graphite powder, or a solder. Since this additional sealing means, applied for example before the shrink fit is made, is so thin, it cannot be shown on the drawing, but is merely indicated schematically by reference numeral 40'. Graphite or solder are suitable as the sealing substances.

The flange portion 23 is held between a flange 8 secured to the wall 3 of the furnace and a flange 52 secured to the housing 21. Screws 55, shown only schematically, couple the flanges 52, 23, 8 together. High temperature-resistant seals 56, 57 can be interposed between the engaging surfaces of the flanges.

The heat exchange tube 7 is sealed within the furnace space 2 in a simple manner without requiring fine or accurate machining of the heat exchange tube 7, and without endangering the heat exchange tube 7, for example by a tendency to fracture. The seal is reliable and secure, so that no exhaust gases, or gases from the furnace atmosphere can escape outwardly into ambient space. Differences of expansion upon change in temperature, between the ring-shaped flange portion 23 and the heat exchange tube 7 are accepted by the sleeve 25. This yielding clamping of the heat exchange tube 7 also protects the heat exchange tube 7 against fissures or cracks due to stresses arising in the material. The flange 23 is made of metal, for example steel, and high temperature-resistant seals 56, 57 permit easy sealing against the flanges 56, and 8, all of which are also made of metal, for example steel.

The sleeve 25 holds the heat exchange tube 7 in axial and radial position. The support tube 30, with its hollow cylindrical portion 33 at the remote or inner end, can accept bending torques. The portion 33 is preferably so dimensioned that, at any temperature of the heat exchange tube 7 which may arise, there is some play or clearance between the heat exchange tube 7 and the support tube 30, so that the portion 33 will not subject the heat exchange tube 7 to thermally induced stresses.

Various changes and modifications may be made within the scope of the inventive concept.

I claim:

1. Radiant heat exchange tube for a furnace, wherein the furnace has a wall, formed with a tube receiving hole (5), said heat exchange tube comprising an elongated tube element (7) of ceramic material;

a flange element (23) having an inner diameter which is greater than the outer diameter of the ceramic tube element (7) for retaining said tube element in the hole (5), through the wall (3) of the furnace; and a sealing arrangement connecting the tube element and the flange element, and sealing the tube element (7) with and to said flange element (23), wherein said sealing arrangement comprises a thin wall sleeve (25) having a first portion (40) shrinkfitted around the ceramic tube element (7), and a second portion (42, 44, 46) which is sealingly connected to said flange element (23), said second porting having an inner diameter which is treater than the outer diameter of the tube element (7).

2. The tube of claim 1, wherein the second portion (42, 44, 46) of the thin wall sleeve (25) is, at least in part, of conical shape.

3. The tube of claim 1, wherein the thin wall sleeve (25) is welded to the flange element (23).

4. The tube of claim 1, wherein the thin wall sleeve (25) extends in longitudinal direction with respect to the tube element (7) and the shrink fit of said first portion (40) is spaced from the flange element (23).

5. The tube of claim 1, wherein the tube (7) comprises silicon carbide ceramic.

6. The tube of claim 1, wherein the thin wall sleeve (25) has a wall thickness which is less than 1 mm.

7. The tube of claim 1, wherein the relationship of wall thicknesses of the sleeve (25) and of the tube element (7) is about 1:10.

8. The tube of claim 1, wherein the thin wall sleeve (25) is made of a material which has a thermal coefficient of expansion which, at least in the temperature range between ambient temperature and operating temperature of said tube, is less than or equal to the thermal coefficient of expansion of the ceramic material of said tube (7).

9. The tube of claim 1, further including a sealing substance (40') located between the first portion (40) of the sleeve and said tube element (7).

10. The tube of claim 9, wherein said sealing substance comprises a high temperature-resistant sealing substance.

11. The tube of claim 9, wherein said sealing substance (40') comprises graphite or solder.

12. The tube of claim 1, further comprising a support tube (30) secured to the flange element (27) and extends from the flange element longitudinally along at least a portion of said ceramic tube (7) and surrounding said sleeve (25).

13. The tube of claim 1, wherein said second portion (42, 44, 46) of the thin wall sleeve (25) is formed of at least two essentially conical sections with an intervening essentially cylindrical section.

14. The tube of claim 1, wherein said second portion (42, 44, 46) of the thin wall sleeve (25) is dilated with respect to said first portion (40) and, at an end of the second portion, said second portion is circumferentially welded to an opening in the flange element (23) along the inner diameter of said flange element (23).

15. The tube of claim 1, in combination with an industrial furnace (1), said ceramic tube being selectively heated or cooling within a furnace space (2) within the furnace, in accordance with operation, or non-operation, of a burner (11), said burner being coupled to an end (9) of said ceramic tube (7), and located outwardly of said furnace space;

a flange structure (8) secured to the wall (3) of the furnace;

and a screw connection (55) coupling the flange element (23) to said flange structure (8).

* * * * *